US007802342B2

(12) United States Patent
Cowan et al.

(10) Patent No.: US 7,802,342 B2
(45) Date of Patent: Sep. 28, 2010

(54) ACOUSTIC CEILING REMOVAL

(75) Inventors: Benjamin David Cowan, Norman, OK (US); James Frank Acker, Moore, OK (US)

(73) Assignee: The Acker-Cowan Group, L.L.C., Norman, OK (US)

( * ) Notice: Subject to any disclaimer, the term of this patent is extended or adjusted under 35 U.S.C. 154(b) by 270 days.

(21) Appl. No.: 11/828,298

(22) Filed: Jul. 25, 2007

(65) Prior Publication Data

US 2008/0023032 A1 Jan. 31, 2008

Related U.S. Application Data

(60) Provisional application No. 60/833,282, filed on Jul. 25, 2006.

(51) Int. Cl.
*A47L 9/06* (2006.01)
*A47L 13/02* (2006.01)

(52) U.S. Cl. ..... 15/322; 15/393; 15/401

(58) Field of Classification Search ..... 15/393, 15/324, 339, 345, 401; *A47L 13/02*
See application file for complete search history.

(56) References Cited

U.S. PATENT DOCUMENTS

| | | | | |
|---|---|---|---|---|
| 1,142,811 | A | 6/1915 | Griswold | |
| 4,443,909 | A | 4/1984 | Cameron | |
| 4,995,914 | A | 2/1991 | Teter | |
| 5,047,089 | A * | 9/1991 | Grant | 134/21 |
| 5,321,869 | A * | 6/1994 | Kaempf | 15/322 |
| 5,386,612 | A | 2/1995 | Sham | |
| 5,575,035 | A | 11/1996 | Reis et al. | |
| 5,590,439 | A | 1/1997 | Alazet | |
| 6,101,663 | A | 8/2000 | Greer, Jr. et al. | |
| 6,120,205 | A * | 9/2000 | Larson | 401/261 |
| 6,165,283 | A | 12/2000 | Dahlin et al. | |
| 6,467,124 | B1 | 10/2002 | Small | |
| 6,601,266 | B1 | 8/2003 | Faraci et al. | |
| 6,625,844 | B2 | 9/2003 | Savage | |
| 6,702,939 | B2 | 3/2004 | Thompson et al. | |
| 6,941,614 | B2 | 9/2005 | Montgomery | |
| 2001/0045220 | A1 | 11/2001 | Fara | |
| 2002/0050245 | A1 | 5/2002 | Kramer et al. | |
| 2004/0110870 | A1 | 6/2004 | Liu | |

FOREIGN PATENT DOCUMENTS

| | | | |
|---|---|---|---|
| JP | 01-174772 | A2 | 7/1989 |
| JP | 01-182457 | A2 | 7/1989 |
| JP | 01-268964 | A2 | 10/1989 |
| JP | 02-132268 | A2 | 5/1990 |
| JP | 08-028026 | A2 | 1/1996 |
| JP | 2000-226942 | A2 | 8/2000 |

* cited by examiner

*Primary Examiner*—David A Redding
(74) *Attorney, Agent, or Firm*—McCarthy Law Group

(57) ABSTRACT

An acoustic ceiling removal tool and associated method are provided wherein an elongated tubular handle defines a longitudinal cavity, and a scraping head is connected to a distal end of the handle. The scraping head has a manifold with a proximal end in fluid communication with the longitudinal cavity and an opposing open end defining a comparatively larger cross sectional area than the proximal end, a scraper blade supported by the manifold to dispose an operative scraping edge of the scraper blade adjacent the open end of the manifold, and an elastomeric boot sealingly engaging the proximal end of the manifold and extending therefrom to circumscribe the open end of the manifold.

1 Claim, 6 Drawing Sheets

(EXISTING ART)

ACOUSTIC CEILING REMOVAL

FIELD OF THE INVENTION

Embodiments of the present invention relate generally to the construction field and more particularly, but not by way of limitation, to a tool and associated method for removing an acoustic ceiling.

SUMMARY

Embodiments of the present invention are generally directed to an apparatus and associated method for removing an acoustic ceiling.

In some embodiments an acoustic ceiling removal tool is provided having an elongated tubular handle defining a longitudinal cavity, and a scraping head is connected to a distal end of the handle. The scraping head has a manifold with a proximal end in fluid communication with the longitudinal cavity and an opposing open end defining a comparatively larger cross sectional area than the proximal end, a scraper blade supported by the manifold to dispose an operative scraping edge of the scraper blade adjacent the open end of the manifold, and an elastomeric boot sealingly engaging the proximal end of the manifold and extending therefrom to circumscribe the open end of the manifold.

In some embodiments an acoustic ceiling removal tool is provided having an elongated tubular handle defining a longitudinal cavity, a manifold having a proximal end in fluid communication with the longitudinal cavity and an opposing open end, a scraper blade supported by the manifold to present a scraping edge of the scraper blade in operative scraping engagement against the ceiling when moving the handle in a first predefined direction, thereby operatively scraping objects from the ceiling into the manifold open end, and a fluid nozzle supported by the handle and connected to a fluid supply, operable to selectively wet the ceiling ahead of the scraping edge.

In some embodiments a method is provided for removing an acoustic ceiling, including the steps of wetting the ceiling with a removal tool by moving the tool relative to the ceiling, contactingly engaging the removal tool against the ceiling, scraping the ceiling with the removal tool by moving the tool relative to the ceiling during the contactingly engaging step and capturing objects scraped from the ceiling via a vacuum force connected to the removal tool, and selectively wetting the ceiling.

These and various other features and advantages which characterize the claimed invention will become apparent upon reading the following detailed description and upon reviewing the associated drawings.

DETAILED DESCRIPTION

Figure 1:
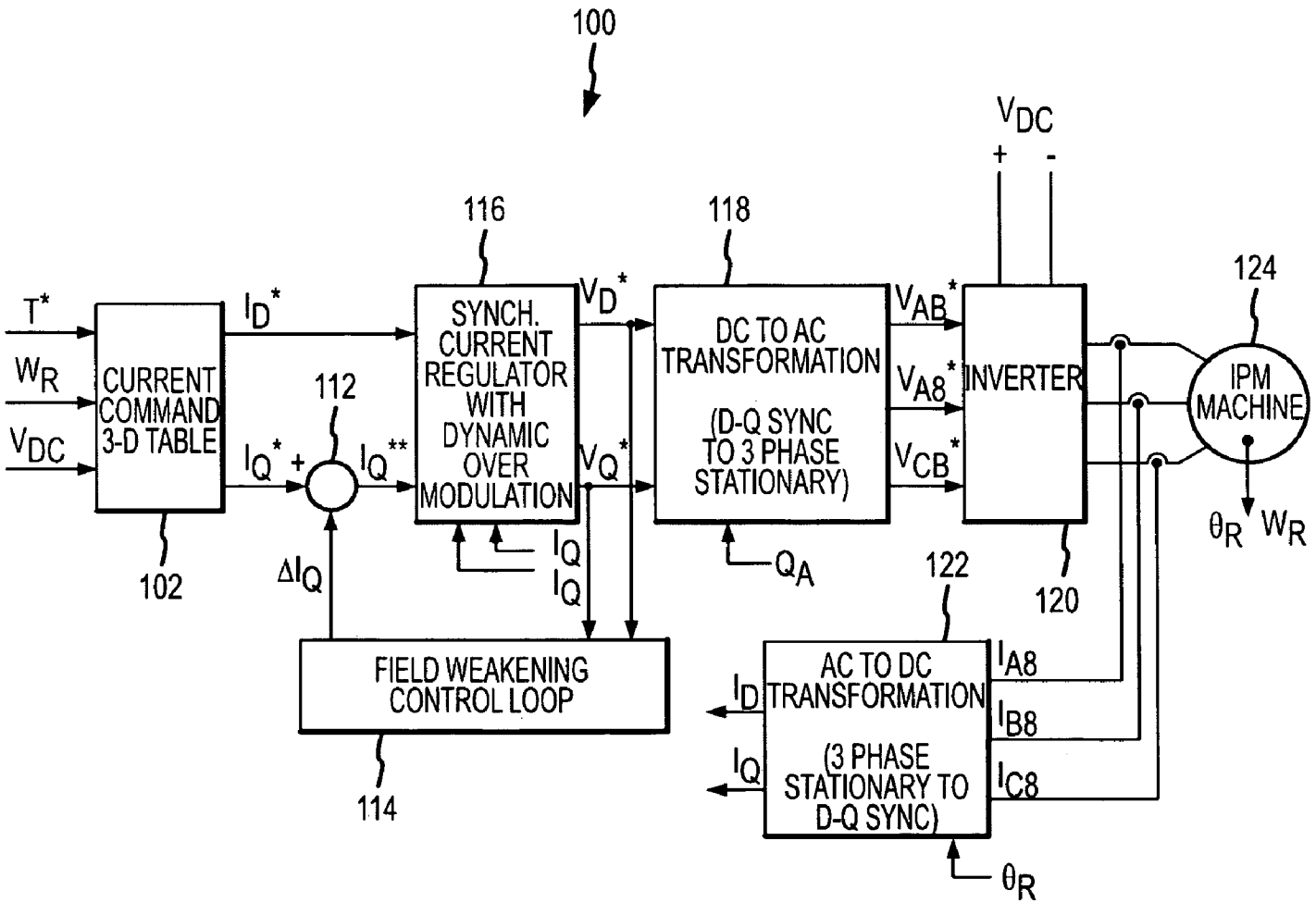
FIG. 1 is an elevational view of an acoustic ceiling removal tool constructed in accordance with embodiments of the present invention.

FIG. 1 is an elevational view of an acoustic ceiling removal tool 100 that is constructed in accordance with embodiments of the present invention. The tool 100 has an elongated tubular handle 102 that is connectable at one end to external utilities and which supports a scraping head 104 at the opposing end. The scraping head 104 includes a replaceable scraper blade 105 and a replaceable elastomeric boot 107 that creates a low pressure zone for effectively capturing moistened objects scraped from the ceiling, as discussed below.

In the illustrative embodiments of FIG. 1 a quick-connect coupling 106 is provided for attaching a vacuum line (not shown). Another quick-connect coupling 108 is provided for attaching a fluid supply line. The vacuum is communicated to the scraping head 104 via the longitudinal cavity defined by the tubular handle 102. The fluid is communicated to the scraping head 104 via a trigger valve 110 that, when opened, pressurizes fluid line 112.

Preferably, the handle 102 is of a length conducive for allowing the operator to stand on the floor while scraping the ceiling. The scraping head 104 can be quickly and easily disconnected from the handle 102 at a coupling 114 in order to use the scraping head 104 as a hand-held tool or to reconnect it to a different-length handle 102.

For controlling the tool 100 a neck strap 116 is provided that can be adjustably connected to the handle 102 depending on the user's height. A handle 118 is likewise adjustably connected to the handle 102, and permits the operator to apply forces against the handle 102 that are translated to scraping forces by the scraping head 104 against the ceiling.

Figure 2:
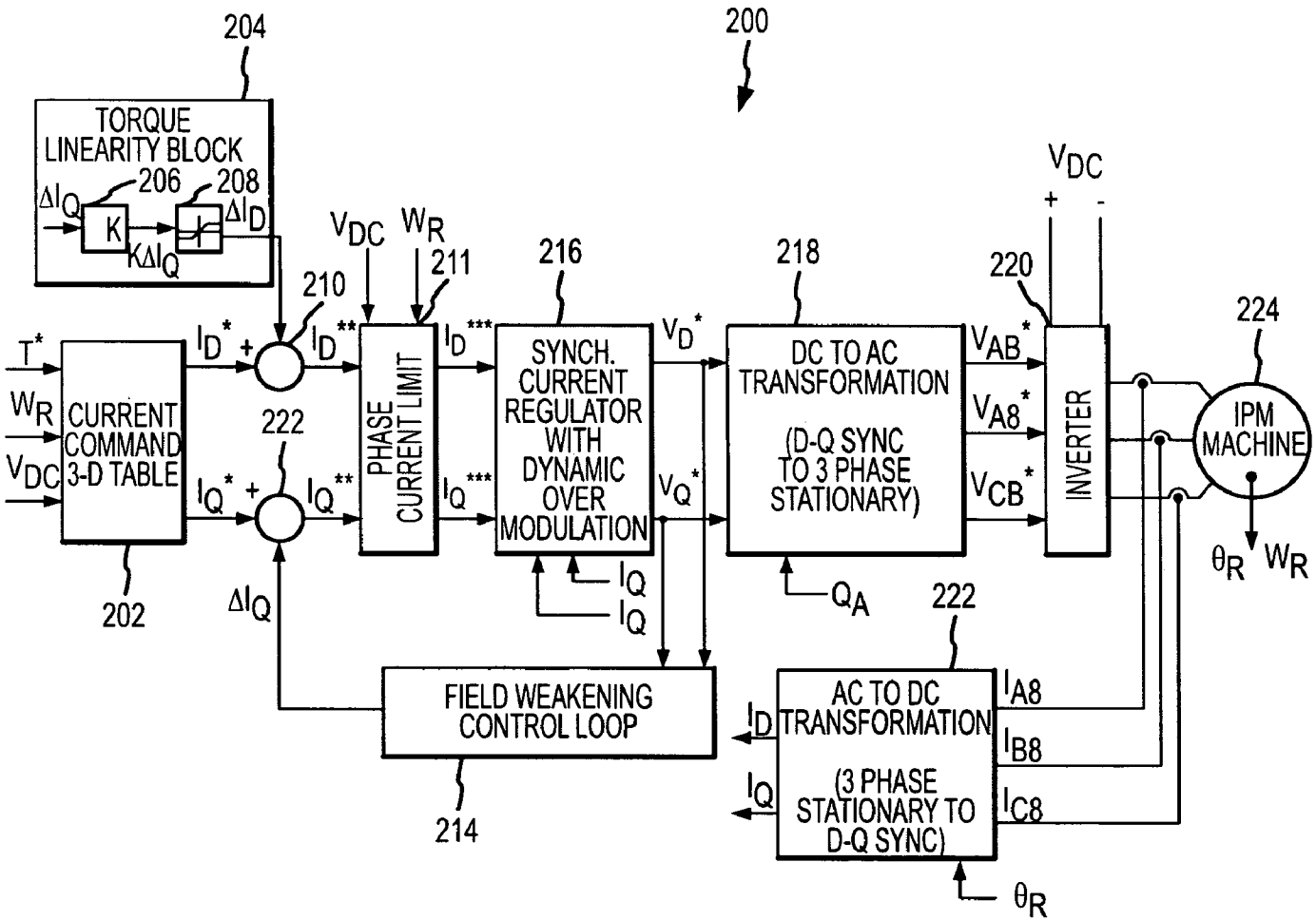
FIG. 2 is an enlarged detail of the manifold portion of the scraping head in the tool of FIG. 1.

FIG. 2 is an enlarged detail of the scraping head 104 with the elastomeric boot 107 removed to more clearly depict a manifold 120 that collects the objects scraped from the ceiling and delivers them to the vacuum source attached to the handle 102. The manifold 120 has a proximal end 122 in fluid communication with the longitudinal cavity defined by the handle 102. An opposing open end 124 of the manifold is disposed beneath the scraper blade 105. The open end 124 is of a comparatively larger cross sectional area than the proximal end 122, such that the manifold 120 is preferably tapered to collect scraped objects and funnel them to the vacuum source.

The distal end of the manifold 120 defines gussets 126 (only one shown) supporting a u-shaped mount 128 that receivingly engages that scraper blade 105. In the illustrative embodiments of FIG. 2 a fastener 130, such as a threaded fastener, passes through both the mount 128 and the attached end of the scraper blade 105. Tightening the fastener 130, such as but not limited to the use of wing nuts (not shown), rigidly fixes the scraper blade 105 to the manifold, allowing the scraper blade to be replaced as required.

An elastomeric planar member 132 is wedged between the manifold 120 and the scraper blade 105. This advantageously permits the scraper blade 105 to be resiliently supported to some extent, which helps to compensate for unevenness in the ceiling surface being scraped. The elastomeric planar member 132 also sealingly engages the scraper blade 105 against the manifold 120 so that the vacuum force is more effectively concentrated within the manifold 120.

Figure 3:
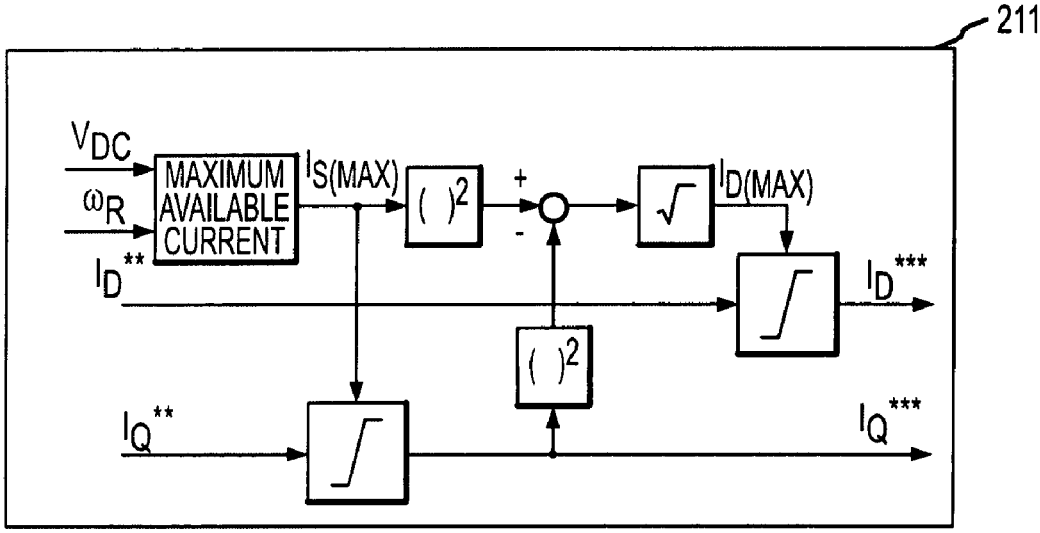
FIG. 3 is a partial cross sectional view of the scraping head of FIG. 1

FIG. 3 is a partial cross sectional view of the scraping head 104 depicting a time when the trigger valve 110 (FIG. 1) is open to produce a fluid stream 134 for wetting the acoustic ceiling material to aid in its removal. As a scraping edge 136 of the scraper blade 105 is pressingly engaged against the ceiling (not shown), the scraping head 104 is pushed in direction 138. The elastomeric boot 107 is sealingly engaged at a lower end thereof to the proximal end 122 of the manifold 120. The elastomeric boot 107 extends upwardly therefrom to circumscribe the open end 124 of the manifold 120. This sealing engagement of the elastomeric boot 107 to the manifold 120 and the sealing engagement of the scraper blade 105 to the manifold creates a negatively pressurized hopper 140. In this way, the air flow and gravity pull the particulates from the scraping operation into the hopper, for subsequent passage into the longitudinal cavity of the handle 120 (FIG. 2) and ultimately, to the vacuum source.

Normally, the scraping head 104 is moved adjacent to the ceiling but without touching it while the fluid stream 134 is being applied to the ceiling; this is sometimes referred to herein as "pre-soaking" a portion of the acoustic ceiling to be removed next.

Figure 4:
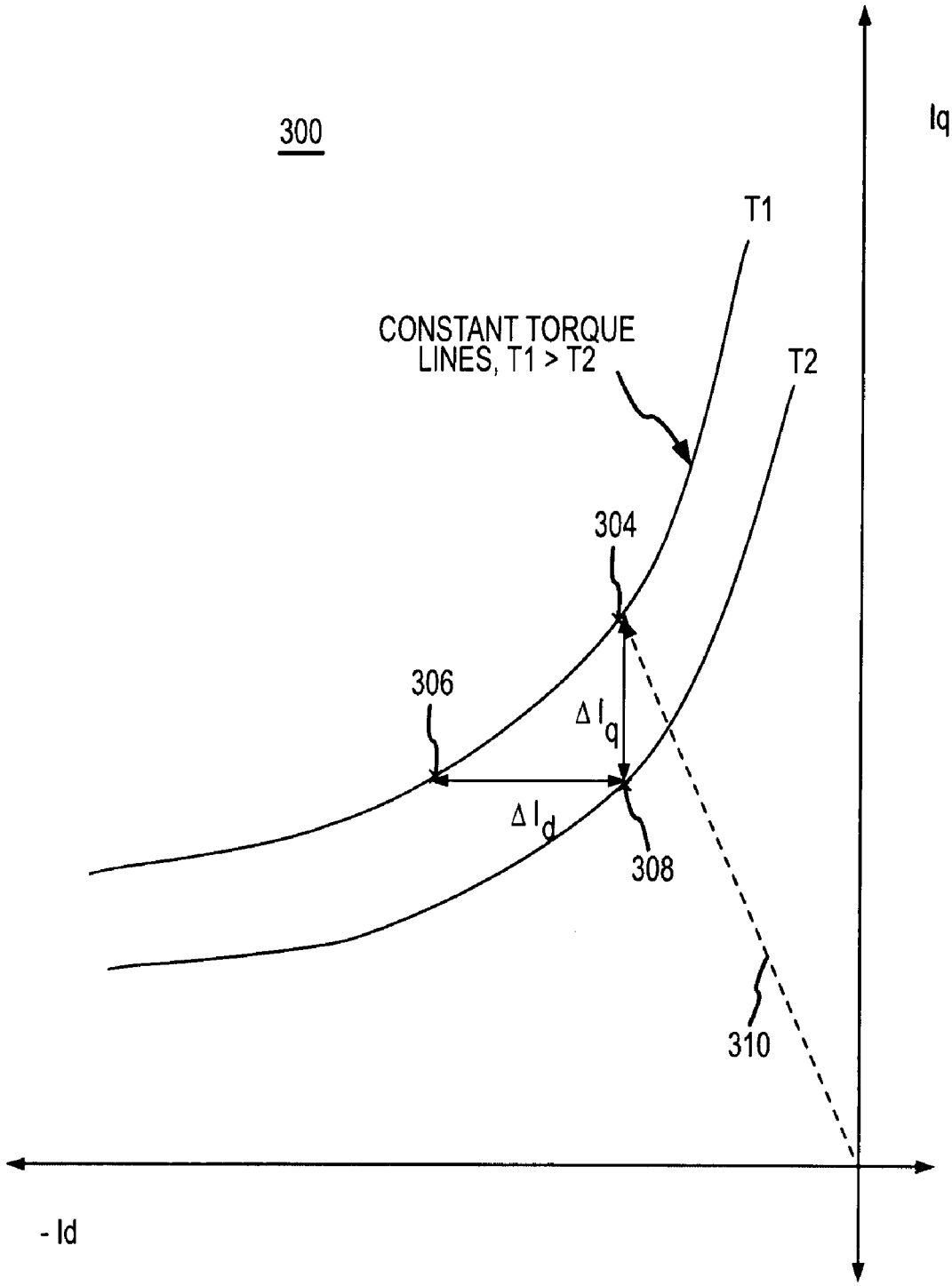
FIGS. 4 and 5 depict how the elastomeric hood compressingly engages the wall to permit scraping the entire ceiling.
Figure 5:
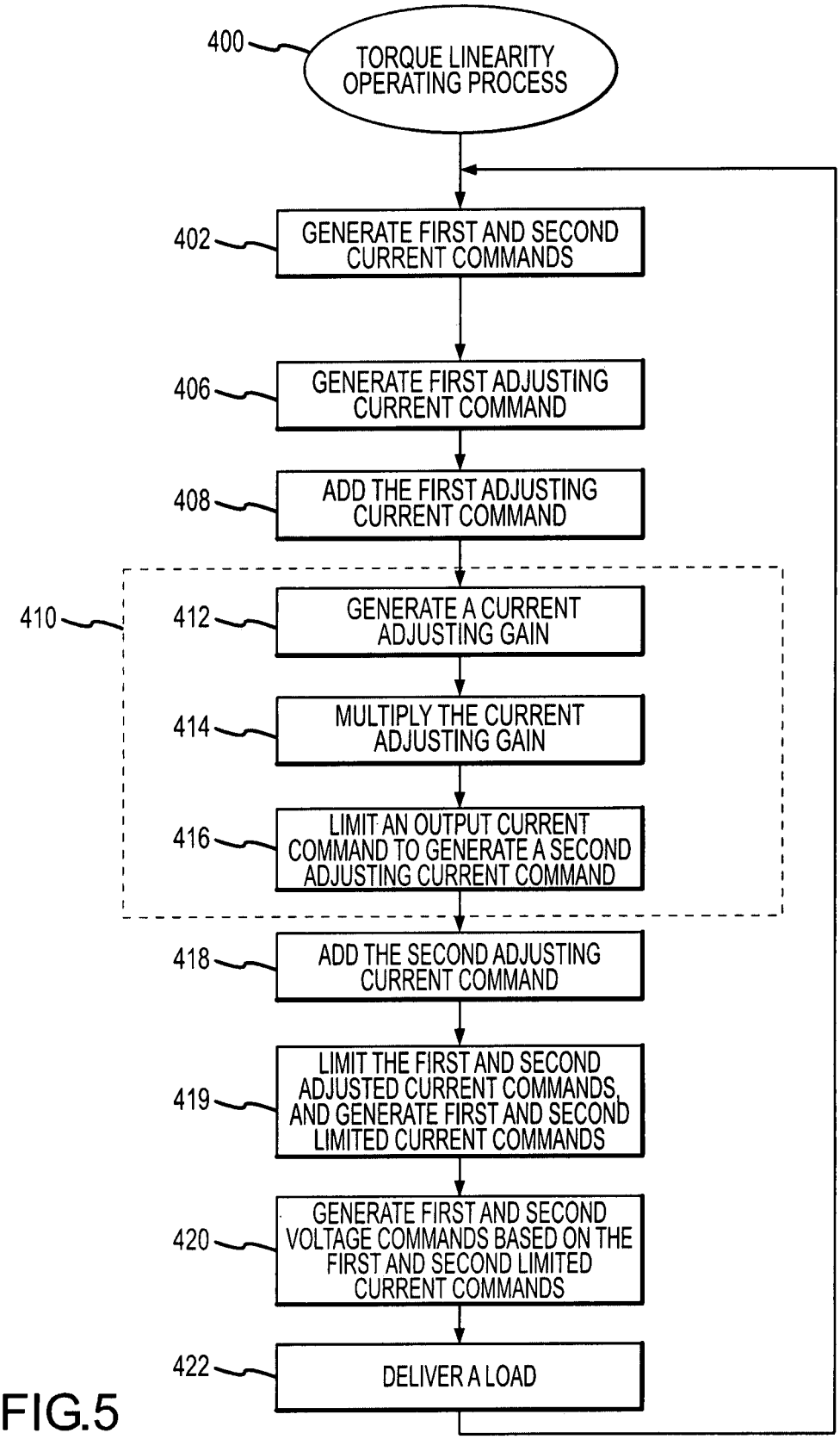

FIGS. 4 and 5 illustrate other advantageous features of the present embodiments associated with using the elastomeric boot 107. In FIG. 4 the scraping head 104 is operably scraping the ceiling 142 while being pushed in direction 138 toward the wall 144. As shown in FIG. 5, the elastomeric boot 107 can compressingly engage the wall 144 enough to permit the scraping edge 136 to reach the corner, thereby enabling the user to remove all the acoustic ceiling material with the tool 100 of the present embodiments.

Figure 6:
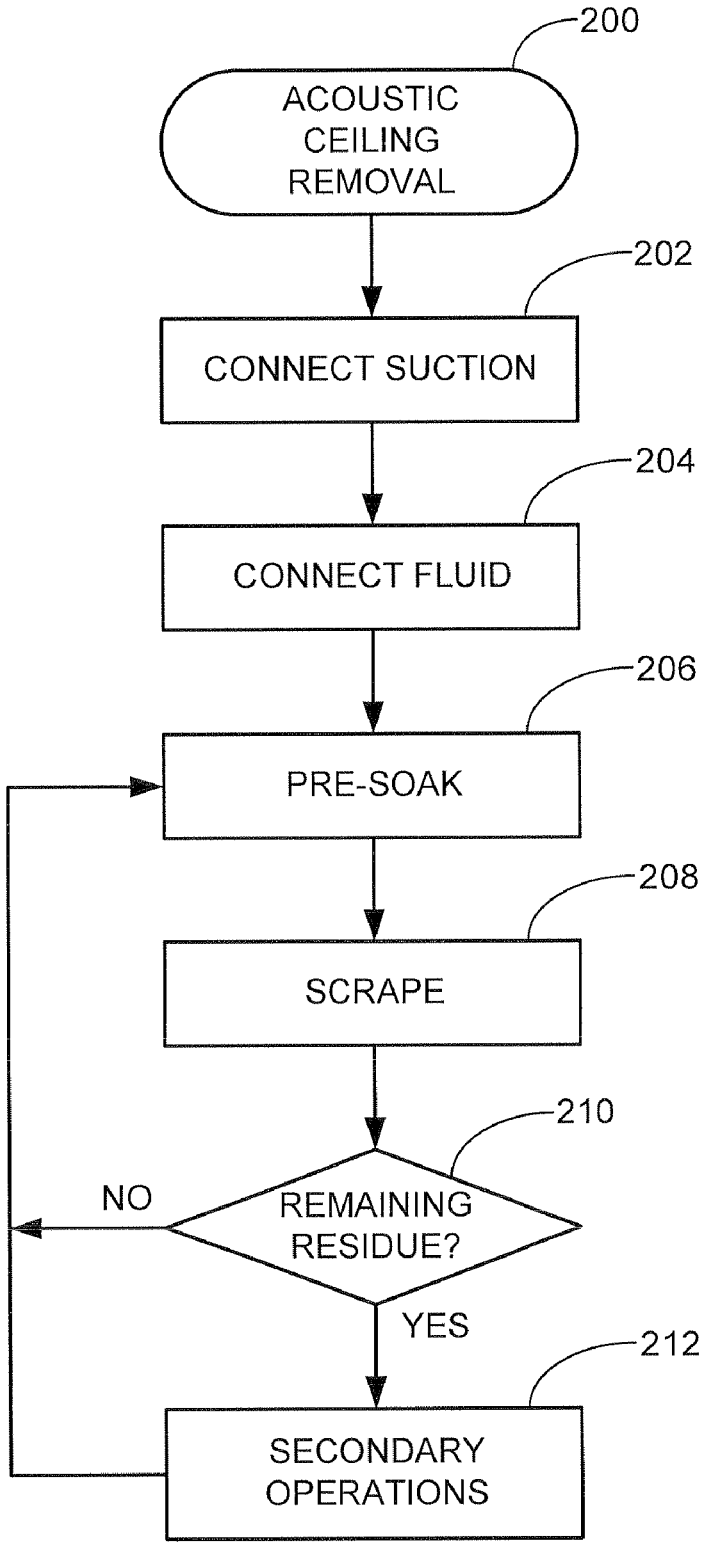
FIG. 6 is a flowchart depicting steps in a method for ACOUSTIC CEILING REMOVAL in accordance with embodiments of the present invention.

FIG. 6 is a flowchart depicting steps in a method 200 for ACOUSTIC CEILING REMOVAL in accordance with embodiments of the present invention. The method 200 begins in block 202 with connecting a vacuum source to the tool 100, such as connecting a suction line to the proximal end of the handle 102. Similarly, in block 204 a fluid supply is connected to the tool 100.

In block 206 a portion of the acoustic ceiling is pre-soaked by moving the scraping head 104 relative to the ceiling and spraying the fluid stream 134 but without scrapingly engaging the ceiling with the scraping edge 136. Preferably, the operation of block 206 generally involves the application of a low pressure misting of fluid (moisture) to moisten the ceiling material. The operator preferably moves the tool 100 over a suitable areal extent of the ceiling in adjacent sweeping motions of perhaps 2-4 feet in length. This is easily accomplished by the balanced, ergonomic support of the tool 100 about the user's body/neck, as described above. Although not required, it is contemplated that the tool 100 is pulled "backward" with respect to the direction of the cutting edge of the scraper 105 as the moisture is applied to the ceiling surface on each pass.

After a predetermined amount of pre-soak time has elapsed, which may be from a few seconds to a few minutes, scraping of the moistened ceiling material is initiated at block 208. The area previously moistened is now preferably subjected to similar sweeping movements of the tool, this time in the direction opposite that used to apply the fluid, and with the cutting edge of the scraper 105 in contacting engagement with the ceiling material. For most ceiling materials, the scraper 105 will easily and cleanly cut through the material, and essentially all particulates will be captured by the associated vacuum.

In block 210 it is determined whether all of the ceiling material from the pre-soaked area of block 206 has been removed; if so, the routine returns to block 206 and a new area of the ceiling is pre-soaked and scraped at block 208, as before. If, however, some measure of residual material remains, such as for example, along a strip of tape between adjoining sheets of sheetrock, the flow passes to block 212 where a secondary operation is carried out in which the residual is again subjected to moistening, a short wait period is enacted, and the residual is scraped. The routine then passes back to block 206 as before.

It will now be appreciated that the placement of the nozzle and resulting fluidic stream 134 ahead of the scraping head 104 (as best shown in FIG. 3) advantageously enables the moistening of the ceiling material to occur during a backstroke as the user pulls the head 104 toward himself, followed by the scraping of the material on a forward stroke as the user advances the head 104 away from himself. This presents significant efficiencies by the user as compared to prior art solutions.

By connecting the tool 100 to a large capacity fluidic source and a correspondingly large collection tank, such as available on commercial carpet cleaning trucks (and or trailers), a significant amount of ceiling area processing can readily take place by a single user, including multiple job sites (e.g., residential homes, etc.) in a single day.

The respective handles such as 118 and strap 116 readily accommodate a wide variety of different users, and enable the center of gravity of the tool 100 to be adjusted so that the tool can be used with great precision and relatively little exertion. Different lengths and/or extensions of tubing can be used to accommodate a variety of ceiling heights.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the particular processing environment without departing from the spirit and scope of the present invention.

In addition, although the embodiments described herein are directed to an acoustic ceiling removal tool, it will be appreciated by those skilled in the art that the claimed subject matter is not so limited and various other tools can be utilized without departing from the spirit and scope of the claimed invention.

What is claimed:

1. An acoustic ceiling removal tool comprising:

an elongated tubular handle defining a longitudinal cavity; and a scraping head connected to a distal end of the handle, the scraping head comprising:

a manifold having a proximal end in fluid communication with the longitudinal cavity and an opening longitudinally displaced from the proximal end defining a comparatively larger cross sectional area than the proximal end;

a scraper blade supported by the manifold to operably extend a scraping edge of the scraper blade longitudinally beyond the opening opposite the proximal end of the manifold; and a hopper sealingly engaging the manifold and extending therefrom to circumscribe the opening, the scraping edge of the scraper blade operably supported longitudinally beyond the hopper opposite the proximal end of the manifold.

* * * * *